US005124053A

United States Patent [19]

Iikubo et al.

[11] Patent Number: 5,124,053

[45] Date of Patent: Jun. 23, 1992

[54] FIRE EXTINGUISHING METHODS AND BLENDS UTILIZING HYDROFLUOROCARBONS

[75] Inventors: Yuichi Iikubo; Mark L. Robin, both of West Lafayette, Ind.

[73] Assignee: Great Lakes Chemical Corporation, West Lafayette, Ind.

[21] Appl. No.: 439,738

[22] Filed: Nov. 21, 1989

Related U.S. Application Data

[63] Continuation-in-part of Ser. No. 396,841, Aug. 21, 1989, abandoned.

[51] Int. Cl.[5] ..... A62D 1/08

[52] U.S. Cl. ..... 252/8; 252/2; 169/46; 169/47

[58] Field of Search ..... 252/8, 3, 2; 169/47, 169/46

[56] References Cited

U.S. PATENT DOCUMENTS

| | | | |
|---|---|---|---|
| 1,926,395 | 9/1933 | Midgley, Jr. | 252/2 |
| 2,456,028 | 12/1948 | Simons | 252/2 |
| 3,479,286 | 11/1969 | Paolo et al. | 252/8 |
| 3,822,207 | 7/1974 | Howard et al. | 252/8 |
| 4,225,404 | 9/1980 | Dietrich et al. | 252/2 |
| 4,459,213 | 7/1984 | Uchida et al. | 252/8.05 |
| 4,668,407 | 5/1987 | Gerard et al. | 252/8 |
| 4,954,271 | 9/1990 | Green | 252/8 |

*Primary Examiner*—Robert L. Stoll
*Assistant Examiner*—Joseph D. Anthony
*Attorney, Agent, or Firm*—Woodard, Emhardt, Naughton, Moriarty & McNett

[57] ABSTRACT

Highly fluorinated, saturated, $C_2$ and $C_3$ hydrofluorocarbons are efficient, economical, non-ozone-depleting fire extinguishing agents used alone or in blends with other fire extinguishing agents in total flooding and portable systems.

25 Claims, No Drawings

FIRE EXTINGUISHING METHODS AND BLENDS UTILIZING HYDROFLUOROCARBONS

CROSS-REFERENCE

This application is a continuation-in-part of applicants' co-pending U.S. Pat. application, Ser. No. 396,841, filed Aug. 21, 1989 now abandoned.

BACKGROUND OF THE INVENTION

1. Field of the Invention

This invention relates to fire extinguishing methods and blends utilizing higher fluorinated $C_2$ and $C_3$ saturated hydrofluorocarbons.

2. Description of the Prior Art

The use of certain bromine, chlorine and iodine-containing halogenated chemical agents for the extinguishment of fires is common. These agents are in general thought to be effective due to their interference with the normal chain reactions responsible for flame propagation. The most widely accepted mechanism for flame suppression is the radical trap mechanism proposed by Fryburg in *Review of Literature Pertinent to Fire Extinguishing Agents and to Basic Mechanisms Involved in Their Action*, NACA-TN 2102 (1950). The finding that the effectiveness of the halogens are on a molar basis in the order Cl<Br<I supports the radical trap mechanism, as reported by Malcom in *Vaporizing Fire Extinguishing Agents*, Report 117, Dept. of Army Engineering Research and Development Laboratories, Fort Bevoir, VA, 1950 (Project- 8-76-04-003). It is thus generally accepted that compounds containing the halogens Cl, Br and I act by interfering with free radical or ionic species in the flame and that the effectiveness of these halogens is in the order I>Br>Cl.

In contrast, hydrofluorocarbons (i.e., compounds containing only C, H and F atoms) have not heretofore been recognized to display any chemical action in the suppression of combustion. Thus, it is generally thought that to be effective as a fire extinguishing agent, a compound must contain Cl, Br or I.

The use of iodine-containing compounds as fire extinguishing agents has been avoided primarily due to the expense of their manufacture or due to toxicity considerations. The three fire extinguishing agents presently in common use are all bromine-containing compounds, Halon 1301 ($CF_3Br$), Halon 1211 ($CF_2BrCl$) and Halon 2402 ($CF_2BrCF_2Br$). The effectiveness of these three volatile eromine-containing compounds in extinguishing fires has been described in U.S. Pat. No. 4,014,799 to Owens. Although not employed commercially, certain chlorine-containing compounds are also known to be effective extinguishing agents, for example Halon 251 ($CF_3CF_2Cl$) as described by Larsen in U.S. Pat. No. 3,844,354.

Although the above named bromine-containing Halons are effective fire fighting agents, those agents containing bromine or chlorine are asserted by some to be capable of the destruction of the earth's protective ozone layer. Also, because the agents contain no hydrogen atoms which would permit their destruction in the troposphere, the agents may also contribute to the greenhouse warming effect.

It is therefore an object of this invention to provide a method for extinguishing fires that extinguishes fires as rapidly and effectively as the techniques employing presently used Halon agents while avoiding the above-named drawbacks.

It is a further object of this invention to provide an agent for the use in a method of the character described that is efficient, economical to manufacture, and environmentally safe with regard to ozone depletion and greenhouse warming effects.

It is a still further object of this invention to provide blends of hydrofluorocarbons and other fire extinguishing agents that are effective and environmentally safe.

SUMMARY OF THE INVENTION

The foregoing and other objects, advantages and features of the present invention may be achieved by employing saturated, higher fluorinated hydrofluorocarbons and blends thereof with other agents as fire extinguishants for use in fire extinguishing methods and apparatus. More particularly, the method of this invention involves introducing to a fire a saturated $C_2$ or $C_3$ higher fluorinated hydrofluorocarbon in a fire extinguishing concentration and maintaining such concentration until the fire is extinguished. Saturated higher fluorinated hydrofluorocarbons of this invention include compounds of the formula $C_xH_yF_z$, where x is 2 or 3: y is 1 or 2; and z is 5, 6 or 7: where y is 1 and z is 5 when x is 2 and where z is 6 or 7 when x is 3. Specific hydrofluorcarbons useful in accordance with this invention include heptafluoropropane ($CF_3CHFCF_3$), 1,1,1,3,3,3-hexafluoropropane ($CF_3CH_2CF_3$), 1,1,1,2,3,3-hexafluoropropane ($CF_3CHFCHF_2$) and pentafluoroethane ($CF_3CHF_2$). These hydrofluorocarbons may be used alone, in admixture with each other or as blends with other fire extinguishing agents. Generally, the agents of this invention are employed at concentrations lying in the range of about 3 to 15%, preferably 5 to 10%, on a v/v basis.

DESCRIPTION OF THE PREFERRED EMBODIMENTS

In accordance with the present invention, saturated higher fluorinated $C_2$ and $C_3$ hydrofluorocarbons have been found to be effective fire extinguishants at concentrations safe for use. However, because such hydrofluorocarbons contain no bromine or chlorine, they have an ozone depletion potential of zero. Furthermore, since the compounds contain hydrogen atoms, they are susceptible to breakdown in the lower atmosphere and hence do not pose a threat as greenhouse warming gasses.

Specific hydrofluorocarbons useful in accordance with this invention are compounds of the formula $C_xH_yF_z$, where x is 2 or 3; y is 1 or 2; and z is 5, 6 or 7; where y is 1 and z is 5 when x is 2; and where z is 6 or 7 when x is 3. Specific hydrofluorcarbons useful in accordance with this invention include heptafluoropropane ($CF_3CHFCF_3$), 1,1,1,3,3,3-hexafluoropropane ($CF_3CH_2CF_3$), 1,1,1,2,3,3-hexafluoropropane ($CF_3CHFCHF_2$), and pentafluoroethane ($CF_3CHF_2$).

These compounds may be used alone or in admixture with each other or in blends with other fire extinguishing agents. Among the other agents with which the hydrofluorocarbons of this invention may be blended are chlorine and/or bromine containing compounds such as Halon 1301 ($CF_3Br$), Halon 1211 ($CF_2BrCl$), Halon 2402 ($CF_2BrCF_2Br$), Halon 251 ($CF_3CF_2Cl$) and $CF_3CHFBr$. Mixtures of heptafluoropropane and Halon 1201 ($CF_2HBr$) are especially preferred because the compounds have similar vapor pressures over a wide range of temperatures and therefore the composition of the mixture remains relatively constant during discharge or other application.

Where the hydrofluorocarbons of this invention are employed in blends, they are desirably present at a level of at least about 10 percent by weight of the blend. The hydrofluorocarbons are preferably employed at higher levels in such blends so as to minimize the adverse environmental effects of chlorine and bromine containing agents.

The hydrofluorocarbon compounds used in accordance with this invention are non-toxic and are economical to manufacture. For example, heptafluoropropane may be conveniently produced via the reaction of commercially available hexafluoropropene ($CF_3CF{=}CF_2$) with anhydrous HF as described in U.K. Patent 902,590. Similarly, 1,1,1,3,3,3-hexafluoropropane may be synthesized by reacting anhydrous HF with pentafluoropropene ($CF_3CH{=}CF_2$) 1,1,1,2,3,3-hexafluoropropane may be obtained by hydrogenation of hexafluoropropene ($CF_3CF{=}CF_2$). Pentafluoroethane may be obtained by the addition of hydrofluoric acid to tetrafluoroethylene ($CF_2{=}CF_2$).

The saturated highly fluorinated $C_2$ and $C_3$ hydrofluorocarbons of this invention may be effectively employed at substantially any minimum concentrations at which fire may be extinguished, the exact minimum level being dependent on the particular combustible material, the particular hydrofluorocarbon and the combustion conditions. In general, however, best results are achieved where the hydrofluorocarbons or mixtures and blends thereof are employed at a level of at least about 3% (v/v). Where hydrofluorocarbons alone are employed, best results are achieved with agent levels of at least about 5% (v/v). Likewise, the maximum amount to be employed will be governed by matters of economics and potential toxicity to living things. About 15% (v/v) provides a convenient maximum concentration for use of hydrofluorocarbons and mixtures and blends thereof in occupied areas. Concentrations above 15% (v/v) may be employed in unoccupied areas, with the exact level being determined by the the particular combustible material, the hydrofluorocarbon (or mixture or blend thereof) chosen and the conditions of combustion. The preferred concentration of the hydrofluorocarbon agents, mixtures and blends in accordance with this invention lies in the range of about 5 to 10% (v/v).

Hydrofluorocarbons may be applied using conventional application techniques and methods used for Halons such as Halon 1301 and Halon 1211. Thus, these agents may be used in a total flooding fire extinguishing system in which the agent is introduced to an enclosed region (e.g., a room or other enclosure) surrounding a fire at a concentration sufficient to extinguish the fire. In accordance With a total flooding system apparatus, equipment or even rooms or enclosures may be provided with a source of agent and appropriate piping, valves, and controls so as automatically and/or manually to be introduced at appropriate concentrations in the event that fire should break out. Thus, as is known to those skilled in the art, the fire extinguishant may be pressurized with nitrogen or other inert gas at up to about 600 psig at ambient conditions.

Alternatively, the hydrofluorocarbon agents may be applied to a fire through the use of conventional portable fire extinguishing equipment. It is usual to increase the pressure in portable fire extinguishers with nitrogen or other inert gasses in order to insure that the agent is completely expelled from the the extinguisher. Hydrofluorocarbon containing systems in accordance with this invention may be conveniently pressurized at any desirable pressure up to about 600 psig at ambient conditions.

Practice of the present invention is illustrated by the following Examples, which are presented for purposes of illustration but not of limitation.

EXAMPLE 1

A 28.3 cubic litre test enclosure was constructed for static flame extinguishment tests (total flooding). The enclosure was equipped with a Plexiglas viewport and an inlet at the top for the agent to be tested and an inlet near the bottom to admit air. To test the agent, a 90×50 mm glass dish was placed in the center of the enclosure and filled with 10 grams of cigarette lighter fluid available under the trademark RONSONOL. The fuel was ignited and allowed a 15 second preburn before introduction of the agent. During the preburn, air was admitted to the enclosure through the lower inlet. After 15 seconds, the air inlet was closed and the fire extinguishing agent was admitted to the enclosure. A predetermined amount of agent was delivered sufficient to provide 6.6% v/v concentration of the agent. The extinguishment time was measured as the time between admitting the agent and extinguishment of the flame. Average extinguishment times for a 6.6% v/v concentration of heptafluoropropane, Halon 1301, Halon 1211 and $CF_3CHFBr$ are given in Table 1.

EXAMPLE 2

The experimental procedure of Example 1 was carried out employing heptane as the fuel. The average extinguishment times for 6.6% v/v of the same agents are also given in Table 1.

TABLE 1

| Extinguishment Time (seconds) for 6.6% v/v Agent | | |
|---|---|---|
| Agent | Lighter fluid | n-Heptane |
| $CF_3CHFCF_3$ | 1.6 | 1.6 |
| $CF_3Br$ (Halon 1301) | 0.8 | 1.4 |
| $CF_2BrCl$ (Halon 1211) | 1.3 | 1.7 |
| $CF_3CHFBr$ | 1.0 | 1.7 |

The Table shows the extinguishment time required for various fuels at 6.6% v/v of the agents employed. At this level, heptafluoropropane is as effective as bromine-containing Halons in extinguishing an n-heptane flame and nearly as effective as the other agents in extinguishing lighter fluid flames.

Levels of about 5–10% are preferred for general application of pure hydrofluorocarbons in accordance with this invention. The use of too little agent results in failure to extinguish the fire and can result in excessive smoke and probably release of HF due to combustion of the agent. The use of excessive amounts is wasteful and can lead to dilution of the oxygen level of the air to levels harmful to living things.

EXAMPLE 3

Example 1 was repeated with two white mice admitted to the chamber. After extinguishment, mice were exposed to combustion products for a total of 10 minutes before being removed from the chamber. All mice showed no ill effects during the exposure and appeared to behave normally after removal from the apparatus.

EXAMPLE 4

Dynamic burn test data for heptafluoropropane and 1,1,1,2,3,3-hexafluoropropane were obtained using the cup burner test procedure in which air and n-butane are continuously supplied to a flame produced in a glass cup burner. Vapor of the agent to be tested was mixed with air and introduced to the flame, with the concentration of agent being slowly increased until the flow was just sufficient to cause extinction of the flame. Data were obtained in this manner for heptafluoropropane and 1,1,1,2,3,3-hexafluoropropane and, for comparative purposes, for the following other Halon agents: Halon 1301 ($CF_3Br$); Halon 1211 ($CF_2BrCl$); Halon 251 ($CF_3CF_2Cl$); Halon 25 ($CF_3CF_2H$); and Halon 14 ($CF_4$). The percent of each agent in air (v/v) required to extinguish the flame is given in Table 2.

TABLE 2

Extinguishment of n-Butane Diffusion Flames

| Agent | Air flow cc/min | Agent Required cc/min | Agent in Air % v/v |
|---|---|---|---|
| Halon 1301 ($CF_3Br$) | 16,200 | 396 | 2.4 |
| Halon 1211 ($CF_2BrCl$) | 16,200 | 437 | 2.7 |
| Halon 251 ($CF_3CF_2Cl$) | 16,200 | 963 | 5.9 |
| $CF_3CHFCF_3$ | 16,200 | 976 | 6.0 |
| $CF_3CHFCHF_2$ | 16,200 | 1312 | 8.1 |
| Halon 25 ($CF_3CF_2H$) | 16,200 | 1409 | 8.7 |
| Halon 14 ($CF_4$) | 16,200 | 2291 | 14.1 |

EXAMPLE 5

Heptafluoropropane and Halon 1301, Halon 1211 and Halon 251 were used to extinguish n-heptane diffusion flames using the method of Example 4. Test data are reported in Table 3.

TABLE 3

Extinguishment of n-Heptane Diffusion Flames

| Agent | Air flow cc/min | Agent Required cc/min | Agent in Air % v/v |
|---|---|---|---|
| Halon 1301 ($CF_3Br$) | 16,200 | 510 | 3.1 |
| Halon 1211 ($CF_2BrCl$) | 16,200 | 546 | 3.4 |
| Halon 251 ($CF_3CF_2Cl$) | 16,200 | 1,006 | 6.2 |
| $CF_3CHFCF_3$ | 16,200 | 1,033 | 6.4 |
| Halon 25 ($CF_3CF_2H$) | 16,200 | 1,506 | 9.3 |

The dynamic test data reported in Tables 2 and 3 demonstrate that use of heptafluoropropane, 1,1,1,2,3,3-hexafluoropropane and pentafluoroethane in accordance with this invention is significantly more effective than other known non-bromine or chlorine containing Halons such as Halon 14 ($CF_4$). Moreover, heptafluoropropane is comparable in effectiveness to Halon 251, a chlorine containing chlorofluorocarbon. The latter relationship is shown with respect to n-heptane as well as n-butane fuels. While bromine and chlorine-containing agents such as Halon 1301 and Halon 1211 are somewhat more effective than the hydrofluorocarbon agents under the cup burner test, the use of the agents in accordance with this invention remains highly effective and their use avoids the significant environmental handicaps encountered with chlorine and bromine containing Halons such as Halon 1301, Halon 1211, and Halon 251.

EXAMPLE 6

Static box flame extinguishment data were obtained for 1,1,1,3,3,3-hexafluoropropane with a 35.2 liter test enclosure using the procedure of Example 1. In addition to 1,1,1,3,3,3-hexafluoropropane, for comparative purposes, Halon 1301, Halon 1211 and Halon 251 were also tested. All agents were delivered at a test concentration of 5.5% (v/v).

TABLE 4

Extinguishment Time (Seconds) for 5.5% (v/v) Agent

| Agent | Extinction Time(s) |
|---|---|
| Halon 1301 ($CF_3Br$) | 1.02 |
| Halon 1211 ($CF_2BrCl$) | 1.76 |
| Halon 251 ($CF_3CF_2Cl$) | 2.15 |
| $CF_3CH_2CF_3$ | 2.98 |

The data of Table 4 demonstrates that 1,1,1,3,3,3-hexafluoropropane is a highly effective fire extinguishant. It is nearly as effective as Halon 251, a chlorofluorocarbon, and it is sufficiently effective, when compared to bromine containing Halons such as Halon 1301 and Halon 1211, that it is preferable by reason of the absence of ozone depletion and other environmental effects of the chlorine and bromine containing Halons.

In addition to being a highly effective agent for extinguishing fires, 1.1.1.3.3.3-hexafluoropropane at concentrations in accordance with the method of this invention is well within the range of toxicological safety.

The following Examples demonstrate the effective use of hydrofluorocarbon agents in accordance with this invention in mixtures or blends including bromine-containing Halon fire extinguishants.

EXAMPLE 7

Dynamic test data using the cup burner procedure of Example 4 were obtained for various mixtures of heptafluoropropane and Halon 1201 ($CF_2HBr$). Air and a mixture of the agents were continuously supplied to an n-heptane diffusion flame produced in a glass cup burner. For a given heptafluoropropane flow, the flow of $CF_2HBr$ was slowly increased until the flow was just sufficient to cause extinction of the flame. The experiment was repeated at various heptafluoropropane flow rates, and the results are reported in Table 6.

Table 6 reports the actual volume percent in air as observed. Table 6 also reports the calculated weight percent heptafluoropropane in the mixture. In addition, Table 6 also reports the ozone depletion potential ("ODP") for each agent. ODP data for Halon 1201 was calculated in the folloWing manner. ODP's for pure compounds were calculated by the following formula:

$$ODP = A\ E\ P\ [(\#Cl)^B + C(\#Br)]\ D^{(\#C-1)}$$

In this expression, P is the photolysis factor. P=1.0 if there are no special structural features which make the molecule subject to tropospheric photolysis. Otherwise, P=F, G, or H, as indicated in the table of constants, Table 5 below.

TABLE 5

| CONSTANT | NAME | VALUE |
|---|---|---|
| F | Photolysis factor for geminal Br—C—Cl | 0.180 |
| G | Photolysis factor for geminal Br—C—Br | 0.015 |
| H | Photolysis factor for adjacent Br—C—C—Br | 0.370 |
| A | Normalizing constant | 0.446 |
| B | Exponent for chlorine term | 0.740 |
| C | Multiplier for bromine term | 32.000 |
| D | Constant for carbon term | 1.120 |
| E | Hydrogen factor [=1.0 for no H's] | .0625 |

ODP's for the mixtures were obtained by multiplying the weight percent of the Halon 1201 by the ODP of pure Halon 1201.

TABLE 6

Extinguishment of n-Heptane Diffusion Flames $CF_3CHFCF_3/CF_2HBr$ Mixtures

| Flow at Extinguishment cc/min | | Vol % in Air | | Total | Weight % | |
|---|---|---|---|---|---|---|
| $CF_3CHFCF_3$ | $CF_2HBr$ | $CF_3CHFCF_3$ | $CF_2HBr$ | vol % | $CF_3CHFCF_3$ | ODP |
| 0 | 1380 | 0 | 4.0 | 4.0 | 0 | 0.89 |
| 164 | 489 | 1.0 | 3.0 | 4.0 | 30.1 | 0.62 |
| 353 | 357 | 2.2 | 2.2 | 4.4 | 56.5 | 0.39 |
| 533 | 216 | 3.3 | 1.3 | 4.6 | 76.6 | 0.21 |
| 705 | 122 | 4.3 | 0.8 | 5.1 | 87.4 | 0.11 |
| 869 | 39 | 5.4 | 0.2 | 5.6 | 97.2 | 0.02 |
| 1042 | 0 | 6.4 | 0 | 6.4 | 100.0 | 0.00 |

These data demonstrate that effective flame extinguishment may be obtained with mixtures of heptafluoropropane and Halon 1201 and that the ODP of Halon 1201 can be materially reduced by providing heptafluoropropane therewith.

EXAMPLES 8-11

Tables 7, 8, 9 and 10 report diffusion flame extinguishment data obtained using the method of Example 7 for the following agent mixtures:

Table 7—heptafluoropropane and Halon 1211 ($CF_2BrCl$).

Table 8—heptafluoropropane and Halon 1301 ($CF_3Br$).

Table 9—pentafluoroethane and Halon 1201 ($CF_2HBr$).

Table 10 —1,1,1,2,3,3-hexafluoropropane and Halon 1201 ($CF_2HBr$).

These Tables also contain ODP data for pure Halons 1211 and 1301 as reported by the Lawrence Livermore Research Laboratories. ODP's for Halon 1201 were calculated using the method given above, and ODP's for the mixtures were obtained by multiplying the weight percent of the Halon agent by the ODP of the pure Halon.

TABLE 7

Extinguishment of n-Heptane Diffusion Flames $CF_3CHFCF_3/CF_2BrCl$ Mixtures

| Flow at Extinguishment cc/min | | Vol % in Air | | Total | Weight % | |
|---|---|---|---|---|---|---|
| $CF_3CHFCF_3$ | $CF_2BrCl$ | $CF_3CHFCF_3$ | $CF_2BrCl$ | vol % | $CF_3CHFCF_3$ | ODP |
| 0 | 546 | 0 | 3.4 | 3.4 | 0 | 2.64 |
| 164 | 437 | 1.0 | 2.7 | 3.7 | 27.5 | 1.91 |
| 262 | 378 | 1.6 | 2.3 | 3.9 | 41.7 | 1.54 |
| 353 | 328 | 2.2 | 2.0 | 4.2 | 53.1 | 1.24 |
| 533 | 210 | 3.3 | 1.3 | 4.6 | 72.5 | 0.73 |
| 705 | 109 | 4.3 | 0.7 | 5.0 | 86.3 | 0.36 |
| 869 | 44 | 5.4 | 0.2 | 5.6 | 94.9 | 0.13 |
| 1042 | 0 | 6.4 | 0 | 6.4 | 100.0 | 0.00 |

TABLE 8

Extinguishment of n-Heptane Diffusion Flames $CF_3CHFCF_3/CF_3Br$ Mixtures

| Flow at Extinguishment cc/min | | Vol % in Air | | Total | Weight % | |
|---|---|---|---|---|---|---|
| $CF_3CHFCF_3$ | $CF_2Br$ | $CF_3CHFCF_3$ | $CF_2Br$ | vol % | $CF_3CHFCF_3$ | ODP |
| 0 | 510 | 0 | 3.1 | 3.1 | 0 | 14.28 |
| 164 | 422 | 1.0 | 2.6 | 3.6 | 30.4 | 9.93 |
| 262 | 334 | 1.6 | 2.1 | 3.7 | 46.4 | 7.65 |
| 353 | 317 | 2.2 | 1.9 | 4.1 | 57.1 | 6.13 |
| 533 | 246 | 3.3 | 1.5 | 4.8 | 71.6 | 4.06 |
| 705 | 98 | 4.3 | 0.6 | 4.9 | 89.2 | 1.54 |
| 869 | 51 | 5.4 | 0.3 | 5.7 | 95.4 | 0.66 |
| 943 | 24 | 5.8 | 0.1 | 6.0 | 98.5 | 0.21 |
| 1042 | 0 | 6.4 | 0 | 6.4 | 100.0 | 0.00 |

TABLE 9

| Extinguishment of n-Heptane Diffusion Flames $CF_3CF_2H/CF_2HBr$ Mixtures | | | | | | |
|---|---|---|---|---|---|---|
| Flow at Extinguishment cc/min | | Vol % in Air | | Total | Weight % | |
| $CF_3CF_2H$ | $CF_2HBr$ | $CF_3CF_2H$ | $CF_2HBr$ | vol % | $CF_3CF_2H$ | ODP |
| 0 | 1380 | 0 | 4.0 | 4.0 | 0 | 0.89 |
| 196 | 526 | 1.2 | 3.2 | 4.4 | 25.6 | 0.66 |
| 314 | 470 | 1.9 | 2.9 | 4.8 | 37.5 | 0.56 |
| 421 | 423 | 2.6 | 2.6 | 5.2 | 47.7 | 0.46 |
| 637 | 338 | 3.9 | 2.1 | 6.0 | 63.0 | 0.33 |
| 1039 | 109 | 6.4 | 0.7 | 7.1 | 89.4 | 0.09 |
| 1509 | 0 | 9.3 | 0 | 9.3 | 100.0 | 0.00 |

TABLE 10

| Extinguishment of n-Heptane Diffusion Flames $CF_3CHFCF_2H/CF_2HBr$ Mixtures | | | | | | |
|---|---|---|---|---|---|---|
| Flow at Extinguishment cc/min | | Vol % in Air | | Total | Weight % | |
| $CF_3CHFCF_2H$ | $CF_2HBr$ | $CF_3CHFCF_2H$ | $CF_2HBr$ | vol % | $CF_3CHFCF_2H$ | ODP |
| 0 | 1380 | 0 | 4.0 | 4.0 | 0 | 0.89 |
| 196 | 508 | 1.2 | 3.1 | 4.3 | 30.8 | 0.62 |
| 421 | 423 | 2.6 | 2.6 | 5.2 | 53.7 | 0.41 |
| 637 | 367 | 3.9 | 2.3 | 6.2 | 66.3 | 0.30 |
| 843 | 207 | 5.2 | 1.3 | 6.5 | 82.1 | 0.16 |

The data of Tables 7 through 10 demonstrate that various mixtures of hydrofluorocarbons in accordance with this invention with chlorine and/or bromine-containing Halons are effective flame extinguishment agents and that significant reductions in ODP of the chlorine and/or bromine containing materials can be obtained by admixture thereof with hydrofluorocarbons in accordance with this invention.

Saturated higher fluorinated $C_2$ and $C_3$ hydrofluorocarbons such as heptafluoropropane, 1,1,1,2,3,3-hexafluoropropane, 1,1,1,3,3,3-hexafluoropropane and pentafluoroethane, like the presently employed chlorine and bromine-containing Halons, are nondestructive agents, and are especially useful where cleanup of other media poses a problem. Some of the applications of the hydrofluorocarbons of this invention are the extinguishing of liquid and gaseous fueled fires, the protection of electrical equipment, ordinary combustibles such as wood, paper and textiles, hazardous solids, and the protection of computer facilities, data processing equipment and control rooms.

We claim:

1. A method for extinguishing a fire comprising the steps of introducing to the fire a fire extinguishing concentration of a composition consisting essentially of one or more hydrofluorocarbon compounds selected from the group consisting of compounds having the formula $C_3H_yF_z$, where y is 1 or 2, and z is 6 or 7; and maintaining the concentration of the compound until the fire is extinguished.

2. A process, as claimed in claim 1, wherein the compound is employed at a level of less than about 15% (v/v).

3. A process, as claimed in claim 1, wherein the extinguishing concentration of the compound is from about 5 to 10% (v/v).

4. A process, as claimed in claim 1, wherein the compound is employed in a total flooding system.

5. A process, as claimed in claim 1, wherein the compound is employed in a portable extinguishing system.

6. The method of claim 1 wherein the composition consists essentially of heptafluoropropane.

7. A process for extinguishing a fire comprising the steps of introducing heptafluoropropane at a concentration of about 5 to 15% (v/v) to the fire and maintaining the concentration of heptafluoropropane until the fire is extinguished.

8. A method for extinguishing a fire comprising the steps of:

introducing to the fire a fire extinguishing concentration of a mixture comprising:

a composition consisting essentially of one or more compounds selected from the group consisting of compounds hydrofluorocarbon having the formula $C_3H_yF_z$, where y is 1 or 2, and z is 6or 7; and one or more chlorine and/or bromine containing fire extinguishing agent selected from the group consisting of $CF_3Br$, $CF_2BrCl$, $CF_2BrCF_2Br$, $CF_2HBr$ and $CF_3CHFBr$, where the compound is present in the mixture at a level of at least about 10% by weight of the mixture; and maintaining the concentration of the mixture until the fire is extinguished.

9. A method, as claimed in claim 8, wherein the fire extinguishing concentration of the mixture is about 3 to 15% (v/v).

10. The method of claim 1 in which said composition consists essentially of 1,1,1,3,3,3-hexafluoropropane, 1,1,1,2,3,3-hexafluoropropane, or heptafluoropropane, or mixtures thereof.

11. The method of claim 8 in which said composition consists essentially of 1,1,1,3,3,3-hexafluoropropane, 1,1,1,2,3,3-hexafluoropropane or heptafluoropropane, or mixtures thereof.

12. The method of claim 8 in which said mixture consists essentially of the composition and the one or more chlorine and/or bromine containing fire extinguishing agent selected from the group consisting of $CF_3Br$, $CF_2BrCl$, $CF_2BrCF_2Br$, $CF_2HBr$ and $CF_3CHFBr$.

13. The method of claim 12 in which the composition consists essentially of 1,1,1,3,3,3-hexafluoropropane, 1,1,1,2,3,3-hexafluoropropane or heptafluoropropane, or mixtures thereof.

14. The method of claim 1 in which said introducing comprises applying the composition to the fire in vapor form.

15. The method of claim 1 in which the composition is non-foaming.

16. The method of claim 1 in which the composition is substantially free of proteins and polyhydroxy compounds.

17. The method of claim 8 in which said introducing comprises applying the composition to the fire in vapor form.

18. The method of claim 8 in which the composition is non-foaming.

19. The method of claim 8 in which the composition is substantially free of proteins and polyhydroxy compounds.

20. A method for extinguishing a fire comprising the steps of:

introducing to the fire a fire extinguishing concentration of a composition consisting essentially of pentafluoroethane; and maintaining the concentration of the composition until the fire is extinguished.

21. The method of claim 20 in which said introducing comprises applying the composition to the fire in vapor form.

22. The method of claim 20 in which the composition is non-foaming.

23. The method of claim 20 in which the composition is substantially free of proteins and polyhydroxy compounds.

24. A method for extinguishing a fire comprising the steps of:

introducing to the fire a fire extinguishing concentration of a composition consisting essentially of pentafluoroethane and one or more compounds selected from the group consisting of 1,1,1,3,3,3-hexafluoropropane, 1,1,1,2,3,3-hexafluoropropane, heptafluoropropane, $CF_3Br$, $CF_2BrCl$, $CF_2BrCF_2Br$, $CF_2HBr$ and $CF_3CHFBr$, and maintaining the concentration of the composition until the fire is extinguished.

25. The method of claim 11 in which the composition consists essentially of heptafluoropropane.

* * * * *

UNITED STATES PATENT AND TRADEMARK OFFICE

CERTIFICATE OF CORRECTION

PATENT NO. : 5,124,053

DATED : June 23, 1992

INVENTOR(S) : Yuichi Ikubo, et. al.

It is certified that error appears in the above-indentified patent and that said Letters Patent is hereby corrected as shown below:

Column 1, line 51, change "eromine" to --bromine--.
Column 3, line 56, change "With" to --with--.
Column 6, line 60, change "folloWing" to --following--.
Column 10, line 42, change "compounds" to --hydrofluorocarbon compounds--.
Column 10, line 43, change "compounds hydrofluorocarbon" to --compounds--.

Signed and Sealed this

Twenty-eighth Day of September, 1993

Bruce Lehman

*Attest:*

BRUCE LEHMAN

*Attesting Officer*

*Commissioner of Patents and Trademarks*

US005124053C1

(12) EX PARTE REEXAMINATION CERTIFICATE (5798th)

United States Patent

Iikubo et al.

(10) Number: US 5,124,053 C1

(45) Certificate Issued: Jul. 3, 2007

(54) FIRE EXTINGUISHING METHODS AND BLENDS UTILIZING HYDROFLUOROCARBONS

(75) Inventors: Yuichi Iikubo, West Lafayette, IN (US); Mark L. Robin, West Lafayette, IN (US)

(73) Assignee: PCBU Services, Inc., Wilmington, DE (US)

Reexamination Request:
No. 90/007,343, Dec. 8, 2004

Reexamination Certificate for:

| | |
|---|---|
| Patent No.: | **5,124,053** |
| Issued: | **Jun. 23, 1992** |
| Appl. No.: | **07/439,738** |
| Filed: | **Nov. 21, 1989** |

Certificate of Correction issued Sep. 28, 1993.

Related U.S. Application Data

(63) Continuation-in-part of application No. 07/396,841, filed on Aug. 21, 1989, now abandoned.

(51) Int. Cl.
*A62D 1/08* (2006.01)

(52) U.S. Cl. ..... 252/8; 252/2; 169/46; 169/47

(58) Field of Classification Search ..... None
See application file for complete search history.

(56) References Cited

U.S. PATENT DOCUMENTS

| | | | |
|---|---|---|---|
| 1,132,636 | A | 3/1915 | Taylor et al. |
| 1,926,395 | A | 9/1933 | Midgley, Jr. |
| 1,926,396 | A | 9/1933 | Midgley, Jr. |
| 2,005,706 | A | 6/1935 | Daudt et al. |
| 2,005,707 | A | 6/1935 | Daudt et al. |
| 2,021,981 | A | 11/1935 | Bichowsky |
| 2,413,696 | A | 1/1947 | Downing et al. |
| 2,456,028 | A | 12/1948 | Simons |
| 2,494,064 | A | 1/1950 | Simons et al. |
| 2,519,983 | A | 8/1950 | Simons |
| 2,576,823 | A | 11/1951 | Benning et al. |
| 2,697,124 | A | 12/1954 | Mantell et al. |
| 2,900,423 | A | 8/1959 | Smith et al. |
| 2,942,036 | A | 6/1960 | Smith et al. |
| 3,080,430 | A | 3/1963 | Cohen |
| 3,258,500 | A | 6/1966 | Swamer et al. |
| 3,436,430 | A | 4/1969 | Hall et al. |
| 3,479,286 | A | 11/1969 | Clun et al. |
| 3,636,173 | A | 1/1972 | Garner |
| 3,656,553 | A | 4/1972 | Rainaldi et al. |
| 3,715,438 | A | 2/1973 | Huggett |
| 3,803,241 | A | 4/1974 | Stolkin et al. |
| 3,822,207 | A | 7/1974 | Howard et al. |
| 3,844,354 | A | 10/1974 | Larsen |
| 4,014,799 | A | 3/1977 | Owens |
| 4,158,023 | A | 6/1979 | Von Halasz |
| 4,225,404 | A | 9/1980 | Dietrich et al. |
| 4,226,728 | A | 10/1980 | Kung |
| 4,446,923 | A | 5/1984 | Martin |
| 4,459,213 | A | 7/1984 | Uchida et al. |
| 4,536,298 | A | 8/1985 | Kamei et al. |
| 4,668,407 | A | 5/1987 | Gerard et al. |
| 4,810,403 | A | 3/1989 | Bivens et al. |
| 4,826,610 | A | 5/1989 | Thacker |
| 4,851,595 | A | 7/1989 | Gumprecht |
| 4,876,405 | A | 10/1989 | Gervasutti |
| 4,937,398 | A | 6/1990 | Tung et al. |
| 4,945,119 | A | 7/1990 | Smits et al. |
| 4,954,271 | A | 9/1990 | Green |
| 5,040,609 | A | 8/1991 | Dougherty et al. |
| 5,068,473 | A | 11/1991 | Kellner et al. |
| 5,084,190 | A | 1/1992 | Fernandez |
| 5,115,868 | A | 5/1992 | Doughertyet al. |
| 5,141,654 | A | 8/1992 | Fernandez |
| 5,146,018 | A | 9/1992 | Kellner et al. |
| 5,364,992 | A | 11/1994 | Manogue et al. |
| 5,430,204 | A | 7/1995 | Manogue et al. |
| 5,621,151 | A | 4/1997 | Manogue |

FOREIGN PATENT DOCUMENTS

| | | | |
|---|---|---|---|
| CA | 902590 | A | 8/1962 |
| CA | 1162511 | | 5/1981 |
| CA | 2081813 | | 10/1992 |
| EP | 0349115 | A1 | 1/1990 |
| EP | 0 383 443 | A2 | 8/1990 |
| EP | 0 481 618 | A1 | 4/1992 |
| EP | 0 570 367 | B1 | 11/1993 |
| GB | 428361 | | 9/1930 |
| GB | 428445 | | 5/1935 |
| GB | 468447 | | 8/1937 |
| GB | 698386 | | 10/1953 |
| GB | 790335 | | 2/1958 |
| GB | 902590 | | 8/1962 |
| GB | 1077932 | | 8/1967 |
| GB | 1132636 | | 11/1968 |
| GB | 1359023 | | 7/1974 |
| GB | 1578933 | | 11/1980 |
| JP | SHO 48-19093 | | 3/1973 |
| JP | 51034595 | | 9/1974 |
| JP | SHO 50-50864 | | 4/1975 |
| JP | SHO 52-25679 | | 7/1977 |
| JP | 57-93070 | A | 6/1982 |
| JP | HEI 1-115999 | | 5/1989 |
| JP | HEI 4-96770 | | 3/1992 |
| WO | WO 91/02564 | | 3/1991 |
| WO | WO 91/04766 | | 4/1991 |
| WO | WO 91/12853 | | 9/1991 |
| WO | WO 91/05752 | | 5/1993 |

OTHER PUBLICATIONS

Nimitz, et al., "Halocarbons as Halon–Replacements: Technology Review and Initiation," New Mexico Engineering Research Institute, University of New Mexico, Final Report, Mar. 1991, 141 pages.

(Continued)

*Primary Examiner*—Jerry D. Johnson

(57) ABSTRACT

Highly fluorinated, saturated $C_2$ and $C_3$ hydrofluorocarbons are efficient, economical, non-ozone-depleting fire extinguishing agents used alone or in blends with other fire extinguishing agents in total flooding and portable systems.

OTHER PUBLICATIONS

"A Review of the Toxic and Asphyxiating Hazards of Clean Agent Replacements for Halon 1301," A Report by the Halon Alternatives Group, Feb. 1995, 22 pages.
Hart–Winchester, "A Burning Issue: What Products Will Replace Halon 1301?" The Computer Operations Manager, Mar./Apr. 1995, pp. 13–18.
Maranghides, et al., "Discharge System Modifications: Real Scale Halon 1301 Replacement Testing," Halon Options Technical Working Conference, Albuquerque, New Mexico, May 7–9, 1996, 12 pages.
Ellis, "Pleasure Boat Fire Extinguisher Choices," Burgee 26, Nov. 1996.
Thornton, Al, "FM–200, A Unique Fire Fighting Agent," 1997 Taipei International Conference on Ozone Layer Protection, Dec. 10, 1997, 10 pages.
The Appeal Decision in invalidation action for Patent No. 2580075, 10 pages (translation), date unknown.
International Fire Protection, "Great Lakes Chemical Corporation—Company Profile," An MDM Publication, Issue 4, Nov./Dec. 2000, 4 pages.
http://www.e1.greatlakes.com/wfp/product/jsp/articles.jsp,
"Airports and Satellite Installations Protected by FM–200(R)," "Healthcare Facilities Protected by FM–200(R) Waterless Fire Protection Systems," "Museums and Cultural Landmarks Protected by FM–200(R)," and "Casino Properties Protected by FM–200(R)."
Hogue, Cheryl, "Substitutes for Halons: No One Chemical Suitable," Intl. Environment Reporter, Nov. 21, 1990, pp. 493–495.
Federal Register, vol. 58, No. 90, May 12, 1993, pp. 28136–28149 and 28176–28185.
"FM–200(R), The New Solution for Fire Protection," Jun. 1993, 11 pages.
Moore, P. E., "Fluorocarbon Halon Alternatives," Fire Safety Engineering, 1997, 3 pages.
Hampson, Roger D., "The Success of FM–200(TM)," Fire Safety Engineering, vol. 2, No. 1, 1995, pp. 21–23.
"Kidde FM–200(R) Fire Suppression Systems," May 1994, 2 pages.
"Real–Scale Halon Replacement Testing," CFC/Halon News, Mar. 1996, one page.
"FM–200(R) Waterless Fire Protection for Marine Applications," 2003, 8 pages.
Burkland, Robert E., "When It Comes to Fire Protection—Speed Counts," Automotive Industry Agenda, Mar. 2002, one page.
Mike Bennett, "Halon Replacement for Aviation Systems", International CFC and Halon Alternatives Conference, Sep. 29 through Oct. 1, 1992, Washington D.C., pp. 667–672.
B. E. Smart, "Flourocarbons", The Chemistry of Functional Groups, Supplement D, Wiley & Sons Ltd., 1983, pp. 603–655.
Chemical Encyclopedia, "Bolshaya Rossiiskaya Entsiklopedia", vol. 3, Med–Pol, Scientific Publishing House, Moscow, 1992, col. 648–649.
"Report of the Halons Technical Options Committee", United Nations Environment Program, Montreal Protocol Assessment, Technology Review, Jun. 2, 1989, preface and pp. 60–65.
"Final Report of the Halons—Technical Options Committee", United Nations Environment Program, Montreal Protocol Assessment Technology Review, Aug. 11, 1989, p. 56.
Marshal Sittig, Chemical Process Monograph No. 22, Methylene Fluoride, 1966, p. 13.
Robert C. Reid, "The Properties of Gases and Liquids", 6–3 Method of Joback, McGraw–Hill, 1987, pp. 154–157.
McLinden, Ph.D, Didion, Ph.D, "Quest for Alternatives", Ashrae Journal, Dec. 1987, pp. 69–78.
The Evolution of the Montreal Protocol, Part IV, Sections 4.1 and 4.2, 1987, pp. 265–275.
Hynes et al., "Shock–Tube Study of the Pyrolsis of the Halon Replacement Molecule $CF_3CHFCF_3$", K. Phys Chem A., vol. 103, pp. 54–61 (1999).
"Joint Assessment of Commodity Chemicals No. 24", Pentafluoroethane (HFC 125), [ECETOC], pp. 14–20 (May 1994).
Kubota, Kazuo, "Current State and Measures Related to Chlorofluorocarbon Regulations, Part 1", Valqua Review, vol. 33, No. 2 , pp. 1–8, 1989 (English Translation).
Malcolm, J.E., "Halogenated Extinguishing Agents; Part II Research at the Corps. Of Engineers' Laboratories", NFPA Quarterly, pp. 119–131, Oct. 1951.
Nelson, Thomas P., "Findings of the Chlorofluorocarbon Chemical Substitutes International Committee", U.S. Environmental Protection Agency, Air and Energy Engineering Research Laboratory, EPA–600/9–88–009, PB88195664, Apr. 1988.
Smart, Bruce E., "Fluorinated Organic Molecules", Molecular Structure and Energetics, vol. 3, Ch. 4, pp. 141–142 (1986).
Tominaga, T. "Global and Technical Countermeasures against Flon", The Nikkan Kogyo Shinbun, Ltd., pp. 134–137, 156–163, 170–174 (1989) (English Translation).
Kirk–Othmer, "*Encyclopedia of Chemical Technology," Catalysis,* 3rd ed., John Wiley & Sones (New York), p. 16–18, 1981.
Milos Hudlicky, *Chemistry of Organic Fluorine Compounds, A Laboratory Manual with Comprehensive Literature Coverage,* 2nd ed., Ellis Horwood (New York), p. 170–179, (Feb. 8, 1992).
Dmitrii D. Moldavskii, "*Technology for the Preparation of Perfluoro–Organic Compounds," Journal of Fluorine Chemistry,* Elsevier Science S.A. (Netherlands), vol. 94 (No. 2), p. 157–167, (Feb. 5, 1999).
Herbert O. House, "*Catalytic Hydrogenation and Dehydrogenation," Modern Synthetic Reactions,* 2nd ed., The Benjamin/Cummings Publishings Company (Menlo Park, CA), p. 1–2, 1972.
J. Kvicala, et al., "*Preparation of Perhalogenated Chlorofluoropropanes by Halogen Exchange in the Liquid and Vapour Phases and Their Isomer Analyses by 19F NMR Spectroscopy," Journal of Fluorine Chemistry,* Elsevier Sequoia (Netherlands), p. 155–175, (Feb. 5, 1989).
F.J. Mettille, et al., "*Methods for the Introductions of Hydrogen Into Fluorinated Compounds," Fluorine Chemistry Reviews,* 1st ed., vol. 1 (No. 2), p. 315–358, (Feb. 5, 1967).
Dr. Mark D. Cisneros, et al., "*An Integrated Approach to Achieve Low Environmental Impact in the Special Hazards Fire Suppression Industry,"* Great Lakes Chemical Corporation (West Lafayette, Indiana), p. 1–8, date unknown.
B.P. Aggarwal, et al., "*Chlorination of Propane and Propylene and Pyrolysis of Perchloropropane," Petroleum & Hydrocarbons,* vol. 3 (No. 2), p. 69–72, (Jul. 5, 1968).
Albert L. Henne, et al., "*Fluorinated Derivatives of Propane and Propylene,"* p. 496–497, (Mar. 5, 1946).

"*Technology of Fluoropolymers*" Drobny; CRC Press; vols. 78–79; pp. 8–11, and 18–19, date unknown.
"*Fire Protection Handbook Fourteenth Edition*" (National Fire Protection Association, Boston) Section 13, Chapter 4, pp. 13–20 to 13–26, 2001.
Burns et al, "*Fluorine Compounds in Anaesthesia*" Anaesthesia, 1982, vol. 37, pp. 278–284.
McFarland, Mack, "*Chlorofluorocarbons and Ozone*" in Environ. Sci. Technol., vol. 23, No. 10, 1989, pp. 1203–1207.
Findings of the Chlorofluorocarbon Chemical Substitutes International Committee: (US EPA, NTIS, Springfield, VA) Apr. 1968, Summary Report (May 4, 1987), pp. A–1 to A–5.
J.E. Malcolm, Engineering Research & Development Labs Report PB 106,268, Interim Report 1171, Aug. 18, 1950.
D.J. Wuebbles, "*The Relative Efficiency of a Number of Halocarbon (sic) for Destroying Stratospheric Ozone*" Lawrence Livermore Laboratory Report UCID–18924 (Jan. 1981).
D.J. Wuebbles, "*Chlorocarbon Emission Scenarios: Potential Impact on Stratospheric Ozone,*" Journal Geophysics Research, vol. 88 at 1433–1443 (1983).
L.T. Molina, et al., "*Ultraviolet Absorption Cross–Sections of Several Brominated Methanes and Ethanes*" Journal of Physical Chemistry, vol. 86, 2672–2676 (1982).
Creitz, Journal of Research of the National Bureau of Standard, 1961, vol. 65A, No. 4, 389–396.
Simons, Fire Extinguishing Agents, in H.G. Bryce, Industrial Aspects of Fluorine Chemistry, at pages 354–358, vol. 5 of Hudlicky, Milos, Chemistry of Organic Flourine Compounds (1962).
R. Hirst and K. Booth, Measurement of Flame–Extinguishing Concentrations, Fire Technology, vol. 13(4): 296–315 (1977).
Final Report on Extinguishing Agents for the Period Sep. 1, 1947 to Jun. 30, 1950 Covering Research Conducted by Purdue Research Foundation and the Department of Chemistry, Purdue University, Contract W–44–009–engr 507, Army Engineers Research and Development Laboratories, Fort Belvoir.

Research at the Corps of Engineers Laboratories, Halogenated Extinguishing Agents, NFPA Quarterly pp. 118–131, (Oct. 1951).

"*Scientific Assessment of Stratospheric Ozone: 1989,*" sponsored by the United Nations Environmental Program.

Report of the Halons Technical Options Committe: Draft for Peer Review, Jun. 1989, Preface and p. 60–65, 1976.

Banks, Findings of the Chlorofluorocarbon Chemical Substitutes International Commitee, Appendix A: summary Report A–1–A–5, May 1987.

Larsen, Halogenated Fire Extin–guishants: Flame Suppression by a Physical Mechanism?, ACS Symp. Ser. 16, p. 376–402, 1975.

Belles, Chemical Action of Halogenated Agents in Fire Extinguishing, Nat. Advis. Comm. For Aeronaut. Techn. Note 3565, pp. 1–29, Sep. 1955.

Moore et al, Halon Alternatives Extingishment Testing, Int. Conf. Of CFC & Halon Alternatives Washington, Oct. 10–11, 1989.

Decision of the Technical Board of Appeal Regarding European Patent No. 0439579, Nov. 14, 2001.

Index to Decisions and Annexes of the Parties to the Montreal Protocol, Helsinki Meeting, p. 79, 128, 241, 1989.

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 6, 8-13 and 17-25 are cancelled.

Claims 1-5, 7 and 14-16 are determined to be patentable as amended.

New claims 26-34 are added and determined to be patentable.

1. A method for extinguishing a fire comprising the steps of introducing to the fire a fire extinguishing concentration of [a composition consisting essentially of one or more hydrofluorocarbon compounds selected from the group consisting of compounds having the formula $C_3H_yF_z$, where y is 1 or 2, and z is 6 or 7;] $CF_3CHFCF_3$ and maintaining the concentration of [the compound] $CF_3CHFCF_3$ until the fire is extinguished.

2. A process, as claimed in claim 1, wherein the [compound] $CF_3CHFCF_3$ is employed at a level of less than about 15% (v/v).

3. A process, as claimed in claim 1, wherein the extinguishing concentration of the [compound] $CF_3CHFCF_3$ is from about 5 to 10% (v/v).

4. A process, as claimed in claim 1, wherein the [compound] $CF_3CHFCF_3$ is employed in a total flooding system.

5. A process, as claimed in claim 1, wherein the [compound] $CF_3CHFCF_3$ is employed in a portable extinguishing system.

7. A process for extinguishing a fire comprising the steps of introducing [heptafluoropropane] $CF_3CHFCF_3$ at a concentration of about 5 to 15% (v/v) to the fire and maintaining the concentration of [heptafluoropropane] $CF_3CHFCF_3$ until the fire is extinguished.

14. The method of claim 1 in which said introducing comprises applying the [composition] $CF_3CHFCF_3$ to the fire in vapor form.

15. The method of claim 1 in which the [composition is] *introducing comprises applying the* $CF_3CHFCF_3$ *to the fire in a* non-foaming *form*.

16. The method of claim 1 in which the [composition is] *introducing comprises applying the* $CF_3CHFCF_3$ *to the fire in a form* substantially free of proteins and polyhydroxy compounds.

*26. A method for extinguishing a fire comprising:*

*providing a fire extinguishant containing* $CF_3CHFCF_3$*;*

*introducing the extinguishant to a fire and forming an ambient concentration of the* $CF_3CHFCF_3$ *sufficient to extinguish the fire; and*

*maintaining the ambient concentration and extinguishing the fire.*

*27. The method of claim 26 wherein the ambient concentration of* $CF_3CHFCF_3$ *is less than 15% (v/v).*

*28. The method of claim 26 wherein the ambient concentration of* $CF_3CHFCF_3$ *is from 5 to 10% (v/v).*

*29. The method of claim 26 wherein the extinguishant is employed in a total flooding system.*

*30. The method of claim 26 wherein the extinguishant is employed in a portable extinguishing system.*

*31. A method for extinguishing a fire comprising:*

*providing a total flooding system operably associated with an enclosed region, the total flooding system employing a fire extinguishing agent containing* $CF_3CHFCF_3$*;*

*introducing the agent to a fire surrounded by the enclosed region and forming around the fire an ambient concentration of 5 to 15% (v/v)* $CF_3CHFCF_3$ *sufficient to extinguish the fire; and*

*maintaining the ambient concentration and extinguishing the fire.*

*32. The method of claim 31 wherein the ambient concentration is non-toxic.*

*33. The method of claim 31 wherein the agent exhibits an ozone depletion potential of zero and poses less of a threat as a greenhouse warming gas than Halon 1301 or 1211.*

*34. The method of claim 31 wherein the ambient concentration of* $CF_3CHFCF_3$ *is from 5 to 10% (v/v).*

* * * * *